US012007153B2

(12) United States Patent
Ochiai

(10) Patent No.: US 12,007,153 B2
(45) Date of Patent: Jun. 11, 2024

(54) REFRIGERATION CYCLE APPARATUS

(71) Applicant: Mitsubishi Electric Corporation, Tokyo (JP)

(72) Inventor: Yasutaka Ochiai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 140 days.

(21) Appl. No.: 17/909,056

(22) PCT Filed: May 20, 2020

(86) PCT No.: PCT/JP2020/019928
§ 371 (c)(1),
(2) Date: Sep. 2, 2022

(87) PCT Pub. No.: WO2021/234854
PCT Pub. Date: Nov. 25, 2021

(65) Prior Publication Data
US 2023/0089678 A1 Mar. 23, 2023

(51) Int. Cl.
*F25B 49/02* (2006.01)
*F24F 11/38* (2018.01)

(52) U.S. Cl.
CPC ..... *F25B 49/025* (2013.01); *F24F 11/38* (2018.01); *F25B 2400/0409* (2013.01); *F25B 2400/0411* (2013.01); *F25B 2700/1931* (2013.01); *F25B 2700/21163* (2013.01)

(58) Field of Classification Search
CPC ..... F24F 11/32; F24F 11/38; F25B 49/025; F25B 2400/0409; F25B 2400/0411; F25B 2700/1931; F25B 2700/21163
See application file for complete search history.

(56) References Cited

U.S. PATENT DOCUMENTS 9,651,286 B2 5/2017 Pham

FOREIGN PATENT DOCUMENTS

EP 2233862 A2 * 9/2010 ..... F25B 13/00
EP 3290816 A1 3/2018
JP H05-141822 A 6/1993
JP H05-231754 A 9/1993
(Continued)

OTHER PUBLICATIONS

International Search Report of the International Searching Authority mailed Aug. 18, 2020 in corresponding International Application No. PCT/JP2020/019928 (and English translation).
(Continued)

*Primary Examiner* — Jonathan Bradford
(74) *Attorney, Agent, or Firm* — Posz Law Group, PLC

(57) ABSTRACT

A refrigeration cycle apparatus includes: a refrigerant circuit in which a compressor, a condenser, an expansion device, and an evaporator are connected by pipes, and refrigerant circulates; a high-pressure sensor that detects a pressure of the refrigerant on a discharge side of the compressor; a first temperature sensor that detects a temperature of the refrigerant on an outlet side of the condenser; and a controller that determines that the high-pressure sensor is abnormal, when the compressor is in operation and the temperature detected by the first temperature sensor is higher than a saturated liquid temperature or a saturated gas temperature that is calculated from the pressure detected by the high-pressure sensor.

12 Claims, 9 Drawing Sheets

(56) References Cited

FOREIGN PATENT DOCUMENTS

| | | | |
|---|---|---|---|
| JP | H08-313125 | A | 11/1996 |
| JP | S63-197858 | A | 8/1998 |
| JP | 3128299 | B | 1/2001 |

OTHER PUBLICATIONS

Extended European Search Report dated May 25, 2023 issued in corresponding European patent application No. 20936885.1.
Office Action dated Jun. 20, 2023 issued in corresponding JP patent application No. 2022-524756 (and English translation).

* cited by examiner

REFRIGERATION CYCLE APPARATUS

CROSS REFERENCE TO RELATED APPLICATION

This application is a U.S. national stage application of PCT/JP2020/019928 filed on May 20, 2020 the contents of which are incorporated herein by reference.

TECHNICAL FIELD

The present disclosure relates to a refrigeration cycle apparatus including a pressure sensor and a temperature sensor.

BACKGROUND ART

An existing detecting technique is provided which detects an abnormality in a pressure sensor and a temperature sensor provided in a refrigeration cycle apparatus such as an air-conditioning apparatus (see, for example, Patent Literature 1).

In a technique described in Patent Literature 1, the evaporating pressure of refrigerant is determined based on a refrigerant temperature detected by a temperature sensor provided at an evaporator, and is compared with a refrigerant pressure detected by a pressure sensor to compute a value, and when the computed value does not fall within a range determined in advance, it is determined that at least one of the pressure sensor and the temperature sensor is abnormal.

CITATION LIST

Patent Literature

Patent Literature 1: Japanese Unexamined Patent Application Publication No. 8-313125

SUMMARY OF INVENTION

Technical Problem

In the technique of Patent Literature 1, it is possible to determine that at least one of the pressure sensor and the temperature sensor is abnormal, but it is not possible to determine which of the pressure sensor and the temperature sensor is abnormal. Thus, even when the pressure sensor is abnormal, it is not possible to determine that the pressure sensor is abnormal.

The present disclosure is applied to solve the above problem, and relates to a refrigeration cycle apparatus including a pressure sensor and a temperature sensor and capable of determining that the pressure sensor is abnormal.

Solution to Problem

A refrigeration cycle apparatus according to an embodiment of the present disclosure includes: a refrigerant circuit in which a compressor, a condenser, an expansion device, and an evaporator are connected by pipes, and refrigerant circulates; a high-pressure sensor configured to detect a pressure of the refrigerant on a discharge side of the compressor; a first temperature sensor configured to detect a temperature of the refrigerant on an outlet side of the condenser; and a controller configured to determine that the high-pressure sensor is abnormal, when the compressor is in operation and the temperature detected by the first temperature sensor is higher than a saturated liquid temperature or a saturated gas temperature that is calculated from the pressure detected by the high-pressure sensor.

A refrigeration cycle apparatus according to another embodiment of the present disclosure includes: a refrigerant circuit in which a compressor, a condenser, an expansion device, and an evaporator are connected by pipes, and refrigerant circulates, a high-pressure sensor configured to detect a pressure of the refrigerant on a high-pressure side of the compressor, a second temperature sensor configured to detect a temperature of the refrigerant which is in a saturated liquid state or a two-phase state; and a controller configured to determine that the high-pressure sensor is abnormal, when the compressor is in operation and the temperature detected by the second temperature sensor is higher than a saturated gas temperature calculated from the pressure detected by the high-pressure sensor.

Advantageous Effects of Invention

In the refrigeration cycle apparatus according to an embodiment of the present disclosure, it is determined that the high-pressure sensor is abnormal when one of the following conditions are met: the compressor is in operation, and the temperature detected by the first temperature sensor is higher than a saturated liquid temperature or a saturated gas temperature that is calculated from the pressure detected by the high-pressure sensor; and the compressor is in operation, and the temperature detected by the second temperature sensor is higher than the saturated gas temperature calculated from the pressure detected by the high-pressure sensor. Therefore, in the case where the pressure sensor and the temperature sensor are provided, it is possible to determine that the pressure sensor is abnormal.

DESCRIPTION OF EMBODIMENTS

Embodiments of the present disclosure will be described below with reference to the drawings. The following descriptions concerning the embodiments are not limiting. In figures to be referred below, relationships in size between in components may differ from actual ones.

Embodiment 1

Figure 1:
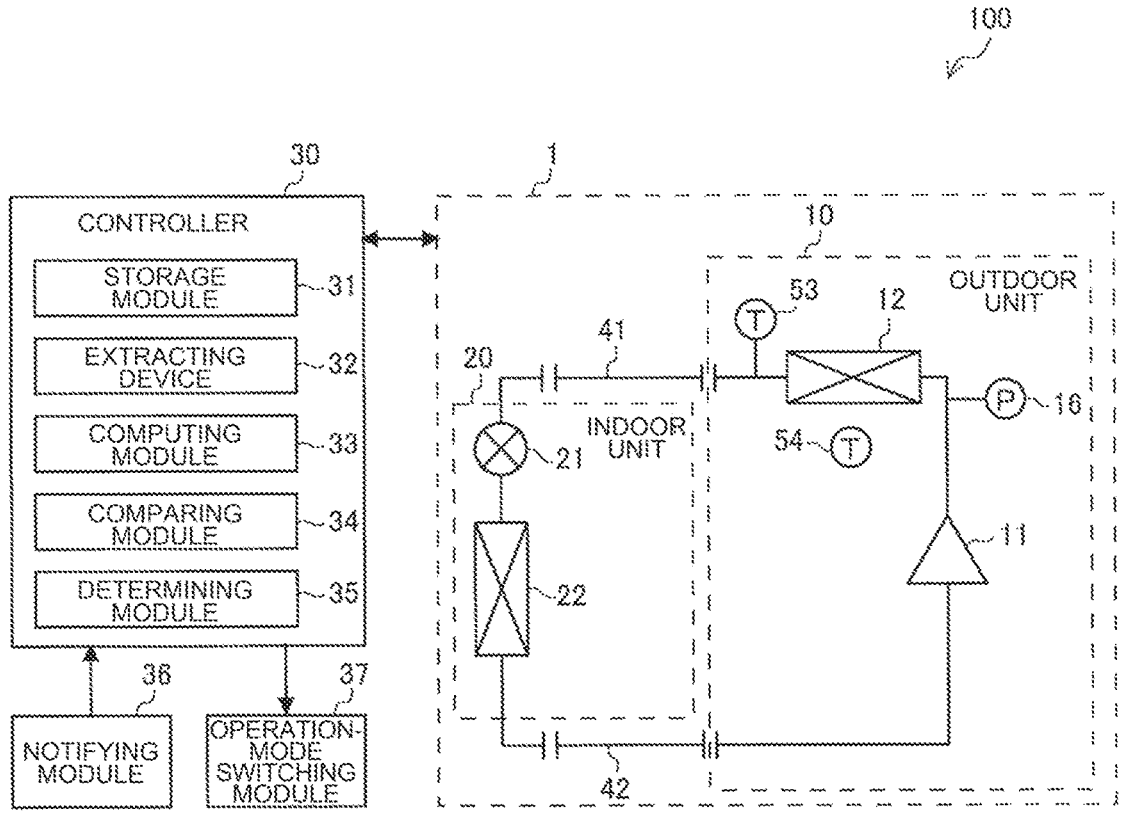
FIG. 1 illustrates a configuration of a refrigeration cycle apparatus according to Embodiment 1.

FIG. 1 illustrates a configuration of a refrigeration cycle apparatus 100 according to Embodiment 1.

In Embodiment 1, as illustrated in FIG. 1, the refrigeration cycle apparatus 100 is, for example, an air-conditioning apparatus in which a single indoor unit 20 is connected to a single outdoor unit 10 by a liquid pipe 41 and a gas pipe 42 (hereinafter referred to as refrigerant pipes) and cooling operation is performed. Although FIG. 1 illustrates the refrigeration cycle apparatus 100 including the single indoor unit 20, the refrigeration cycle apparatus 100 may include a plurality of indoor units 20. In this case, each of the indoor units 20 is connected in parallel with the outdoor unit 10 by a refrigerant pipe.

The outdoor unit 10 includes a compressor 11, a condenser 12, a high-pressure sensor 16, a condenser-outlet-temperature sensor 53, and a condenser-ambient-temperature sensor 54. It should be noted that the high-pressure sensor 16, the condenser-outlet-temperature sensor 53, and the condenser-ambient-temperature sensor 54 will also be referred to also as a pressure sensor, a first temperature sensor, and a third temperature sensor, respectively.

The indoor unit 20 includes an expansion device 21 and an evaporator 22.

The refrigeration cycle apparatus 100 includes a refrigerant circuit 1 in which the compressor 11, the condenser 12, the expansion device 21, and the evaporator 22 are sequentially connected by refrigerant pipes and refrigerant circulates. The refrigerant circuit 1 is sealed, with azeotropic refrigerant contained therein. The refrigerant circuit 1 may be connected to a flow switching device such as a four-way valve, whereby it is possible to heating operation in addition to the cooling operation.

The refrigeration cycle apparatus 100 includes a controller 30, a notifying module 36, and an operation-mode switching module 37. The controller 30 is connected to the notifying module 36 and the operation-mode switching module 37. The notifying module 36 and the operation-mode switching module 37 may be provided in the controller 30 as part of the controller 30.

The compressor 11 is a fluid machine that sucks and compresses low-temperature and low-pressure gas refrigerant to change it into high-temperature and high-pressure gas refrigerant, and discharges the high-temperature and high-pressure gas refrigerant. When the compressor 11 operates, refrigerant circulates in the refrigerant circuit 1. The compressor 11 is, for example, an inverter-driven compressor whose operating frequency can be adjusted. The operation of the compressor 11 is controlled by the controller 30.

The condenser 12 causes heat exchange to be performed between refrigerant and outdoor air. It should be noted that a fan (not illustrated) may be provided close to the condenser 12. In this case, it is possible to change an air volume by changing the rotation speed of the fan, and thus change the amount of heat to be transferred to outdoor air, that is, the amount of heat exchange.

The expansion device 21 causes refrigerant to be adiabatically expanded. The expansion device 21 is, for example, an electronic expansion valve or a thermostatic expansion valve. The opening degree of the expansion device 21 is controlled by the controller 30 such that the degree of superheat at the outlet of the evaporator 22 approaches a target value.

The evaporator 22 causes heat exchange to be performed between refrigerant and indoor air. It should be noted that a fan (not illustrated) may be provided close to the evaporator 22. In this case, it is possible to change an air volume by changing the rotation speed of the fan, and thus change the amount of air to be received from indoor air, that is, the amount of heat exchange.

The high-pressure sensor 16 is provided on a discharge side of the compressor 11. The high-pressure sensor 16 detects the pressure on the discharge side of the compressor 11, and outputs a detection signal to the controller 30. In the high-pressure sensor 16, for example, the pressure of refrigerant is received by a diaphragm, detected by a pressure sensitive element via oil pressure, and converted into an electrical signal as an output corresponding to the detected pressure. The high-pressure sensor 16 then outputs the electric signal obtained in the above manner.

The condenser-outlet-temperature sensor 53 is provided between the condenser 12 and the expansion device 21. The condenser-outlet-temperature sensor 53 detects a temperature T(53) on the outlet side of the condenser 12 (which will be hereinafter referred to as condenser outlet temperature), and outputs a detection signal to the controller 30. The condenser-ambient-temperature sensor 54 is provided close to the condenser 12. The condenser-ambient-temperature sensor 54 detects a temperature T(54) in the surroundings of the condenser 12 (which will be hereinafter referred to as condenser ambient temperature), and outputs a detection signal to the controller 30. Each of the condenser-outlet-temperature sensor 53 and the condenser-ambient-temperature sensor 54 is, for example, a thermistor whose resistance varies depending on temperature.

The controller 30 includes, for example, a dedicated hardware module, or a central processing module (CPU; and also referred to as processing module, arithmetic module, microprocessor, or processor) that executes a program stored in a storage module 31, which will be described later.

In the case where the controller 30 is a dedicated hardware module, the controller 30 corresponds to, for example, a single circuit, a composite circuit, an application specific integrated circuit (ASIC), a field-programmable gate array (FPGA), or a combination thereof. Functional modules to be implemented by the controller 30 may be implemented by respective hardware modules, or the functional modules may be implemented by a single hardware module.

In the case where the controller 30 is a CPU, functions that are fulfilled by the controller 30 are fulfilled by software, firmware, or a combination of software and firmware. The software and firmware are each written as a program, and stored in the storage module 31. When the CPU reads and executes the program stored in the storage module 31, each function of the controller 30 is fulfilled.

Part of the functions of the controller 30 may be fulfilled by dedicated hardware, and other part of the functions may be fulfilled by software or firmware.

The controller 30 controls the compressor 11, the expansion device 21, and other components based on detection signals from various sensors provided in the refrigeration cycle apparatus 100, operation signals from the operation module (not illustrated) and other information, to thereby control the overall operation of the refrigeration cycle apparatus 100. The controller 30 may be provided in the outdoor unit 10 or the indoor unit 20, or may be provided outside the outdoor unit 10 and the indoor unit 20.

The controller 30 includes, as functional blocks to make a sensor abnormality determination that is a determination whether a sensor abnormality occurs or not: the storage module 31, an extracting module 32, a computing module 33, a comparing module 34, and a determining module 35. It should be noted that the sensor abnormality determination means a determination whether or not an abnormality occurs in the pressure sensor or the temperature sensor in the refrigeration cycle apparatus 100.

The storage module 31 stores various information, and includes, for example, a rewritable non-volatile semiconductor memory, such as a flash memory, an EPROM, or an EEPROM. The storage module 31 may additionally include a rewritable non-volatile semiconductor memory such as a ROM, or a rewritable volatile semiconductor memory such as a RAM. The storage module 31 stores temperature data and pressure data individually detected by various sensors. Such temperature data and pressure data are periodically acquired while the refrigeration cycle apparatus 100 is in operation.

The extracting module 32 extracts, from among various data stored in the storage module 31, data required for the determination whether a sensor abnormality occurs or not. This sensor abnormality determination is made using data obtained when the compressor 11 is in operation. This is because when the compressor 11 is not in operation, it is not possible to correctly determine whether a sensor abnormality occurs or not.

The computing module 33 performs a required computation based on the data extracted by the extracting module 32. The computing module 33 calculates, from pressure data detected by the high-pressure sensor 16, a high-pressure-side saturated liquid temperature TL(P16) or a high-pressure-side saturated gas temperature TG(P16).

The comparing module 34 compares a value calculated by the computing module 33 with a preset threshold or other values, or compare values calculated by the computing module 33 with each other. The comparing module 34 makes comparisons between values such as TL(P16), TG(P16), T(53), and T(54).

The determining module 35 determines determine whether an abnormality occurs in the pressure sensor or the temperature sensor or not, based on the result of comparison by the comparing module 34.

The notifying module 36 makes a notification indicating various information such as occurrence of an abnormality, in response to a command from the controller 30. The notifying module 36 includes at least one of a display module that visually indicates information and a sound output module that auditorily indicates information.

The operation-mode switching module 37 receives an input for a switching operation that is done by a user for switching between operation modes. When an operation for switching between operation modes is performed by the operation-mode switching module 37, a signal is output from the operation-mode switching module 37 to the controller 30, and the controller 30 switches an operation mode to be applied, between the operation modes, in response to the signal. As the operation modes between which the switching is performed by the controller 30, at least a normal operation mode and a sensor-abnormality determination mode are present.

Next, an operation of the refrigeration cycle apparatus 100 according to Embodiment 1 will be described.

High-temperature and high-pressure gas refrigerant discharged from the compressor 11 flows into the condenser 12. In the condenser 12, the gas refrigerant exchanges heat with outdoor air and thus condenses to change into high-pressure liquid refrigerant, and the high-pressure liquid refrigerant flows out of the condenser 12. After flowing out of the condenser 12, the liquid refrigerant is decomposed by the expansion device 21 and changes into low-pressure two-phase refrigerant, and the low-pressure two-phase refrigerant flows the evaporator 22. In the evaporator 22, the refrigerant exchanges heat with indoor air and thus evaporates to change into low-temperature and low-pressure gas refrigerant, and the low-temperature and low-pressure gas refrigerant flows out of the evaporator 22. After flowing out of the evaporator 22, the gas refrigerant is sucked by the compressor 11 and is re-changed into high-temperature and high-pressure gas refrigerant, and the high-temperature and high-pressure gas refrigerant is discharged from the compressor 11.

It will be described what is the cause of occurrence of an abnormality in each of the pressure sensor and the temperature sensor.

As described above, in pressure sensors such as the high-pressure sensor 16, for example, the pressure of refrigerant is received by the diaphragm, detected by a pressure sensitive element via oil pressure, and converted into an electrical signal corresponding to the detected pressure, and the electrical signal is output. Therefore, for example, an abnormality in the pressure sensor can be considered to occur for the following cause: an oil-filled unit deteriorates to allow oil to flow out therefrom and air to enter the oil-filled unit, as a result of which the accuracy of a value that is detected by the pressure sensor gradually lowers, as compared with that in a normal condition. This occurs due to reduction of propagation of a pressure to a piezoelectric element that is caused by the mixture of a gas, which is a compressible fluid, into an oil part. In the case where such an abnormality occurs, the accuracy of a value that is detected by the pressure sensor gradually lowers, as compared with that in the normal condition. Consequently, it is not easily determined that an abnormality occurs.

As described above, the temperature sensor such as the condenser-outlet-temperature sensor 53 is, for example, a thermistor. For example, an NTC element is used as a thermistor element. Such an NTC element is featured in that it has a resistance that increases as an ambient temperature decreases. The thermistor includes a semiconductor and a signal line that are soldered to each other. In the temperature sensor, an abnormality can be considered to occur for the following reason: the solder melts or the semiconductor chip chips because of aging degradation, as a result of which energization cannot be easily achieved and the resistance is increased, and the accuracy of a value that is detected by the sensor gradually lowers, as compared with that in the normal condition.

It will be described how to detect an abnormality that occurs in each of the high-pressure sensor 16 and the condenser-outlet-temperature sensor 53 of the refrigeration cycle apparatus 100 according to Embodiment 1.

Figure 2:
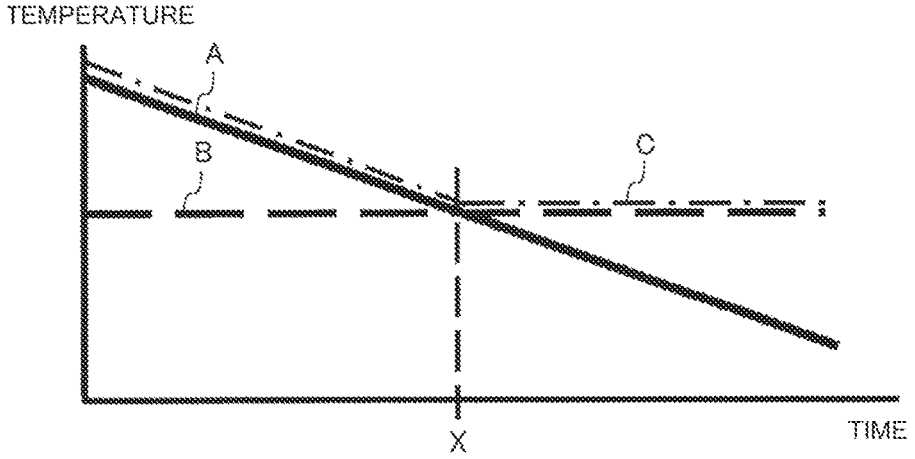
FIG. 2 indicates changes in values detected by various sensors in the refrigeration cycle apparatus according to Embodiment 1.

FIG. 2 indicates changes in values detected by the various sensors of the refrigeration cycle apparatus 100 according to Embodiment 1. In FIG. 2, the vertical axis represents temperature, and the horizontal axis represents time. Line A represents a saturated liquid temperature for the high-pressure sensor 16 in the case where a value detected by the high-pressure sensor 16 is reduced with time due to occurrence of an abnormality in the high-pressure sensor 16. Line B represents a condenser outlet temperature. Line C represents a saturated liquid temperature for the high-pressure sensor 16 in the case where refrigerant gradually flows out from the refrigerant circuit 1.

As indicated FIG. 2, in line C that indicates that a leak of refrigerant occurs, the state of the refrigerant on the outlet side of the condenser 12 becomes a saturated liquid state at time X, and thereafter the refrigerant is kept in a two-phase state and the temperature of the refrigerant is thus substantially equivalent to that indicated by line B. It can be also seen that after time X, the value indicated by line A decreases to be less than the value represented by line B.

As long as the high-pressure sensor 16 is normal, the saturated liquid temperature and the saturated gas temperature are both substantially equivalent to the condensing temperature. Therefore, even when the refrigerant on the outlet side of the condenser 12 enters a two-phase state, the saturated temperature does not fall below the condenser outlet temperature. When the high-pressure sensor 16 is abnormal, however, the saturated liquid temperature falls below the condenser outlet temperature. From this, it can be seen that the pressure sensor is abnormal.

The difference between line A and line B corresponds to the degree of subcooling at the outlet of the condenser 12. When the high-pressure sensor 16 is normal, the degree of subcooling is greater than or equal to 0. This means that it can be determined that the pressure sensor is abnormal when the degree of subcooling is negative.

Figure 3:
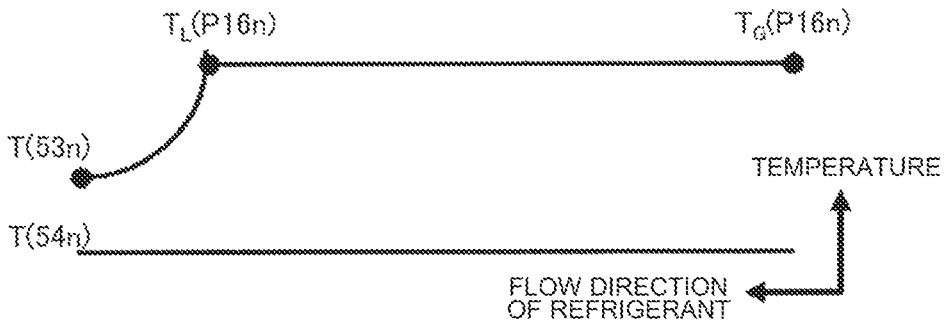
FIG. 3 indicates values that are detected by the various sensors of the refrigeration cycle apparatus according to Embodiment 1 when the sensors are normal.
Figure 4:
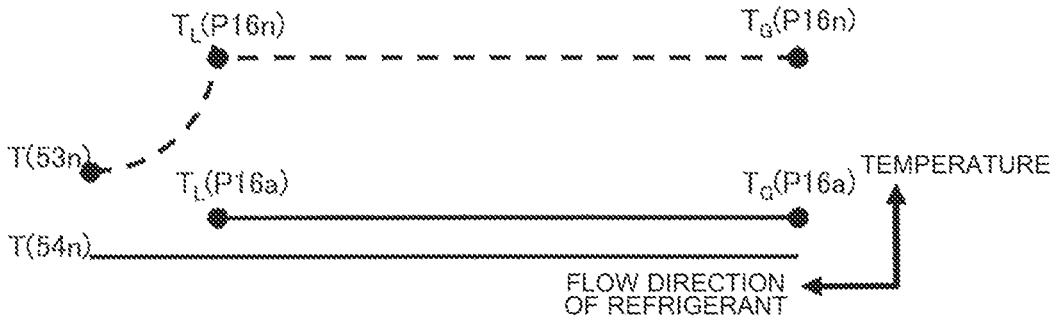
FIG. 4 indicates values that are detected by the various sensors of the refrigeration cycle apparatus according to Embodiment 1 when a pressure sensor is abnormal.
Figure 5:
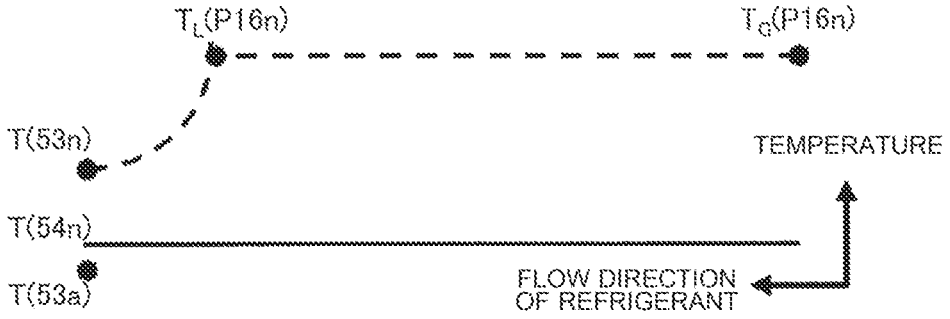
FIG. 5 illustrates values that are detected by the various sensors of the refrigeration cycle apparatus according to Embodiment 1 when a first temperature sensor is abnormal.

FIG. 3 indicates values that are detected by the various sensors in the refrigeration cycle apparatus 100 according to Embodiment 1, when the sensors are normal. FIG. 4 indicates values that are detected by the various sensors in the refrigeration cycle apparatus 100 according to Embodiment 1 when the high-pressure sensor 16 is abnormal. FIG. 5 illustrates values that are detected by the various sensors of the refrigeration cycle apparatus 100 according to Embodiment 1 when the condenser-outlet-temperature sensor 53 is abnormal.

When the values detected by the various sensors are normal, T(54*n*), T(53*n*), TL(P16*n*), and TG(P16*n*) satisfy such a relationship as described below, as indicated in FIG. 3. It should be noted that T(54*n*) is a condenser ambient temperature that is detected by the condenser-ambient-temperature sensor 54 when the condenser-ambient-temperature sensor 54 is normal, T(53*n*) is a condenser outlet temperature that is detected by the condenser-outlet-temperature sensor 53 when the condenser-outlet-temperature sensor 53 is normal, TL(P16*n*) is a saturated liquid temperature calculated from a pressure that is detected by the high-pressure sensor 16 when the high-pressure sensor 16 is normal, and TG(P16*n*) is a saturated gas temperature calculated from the pressure that is detected by the high-pressure sensor 16 when the high-pressure sensor 16 is normal.

$$T(54n) \leq T(53n) \leq TL(P16n) = TG(P16n)$$

When the high-pressure sensor 16 is abnormal, T(54*n*), T(53*n*), TL(P16*a*), and TG(P16*a*) satisfy such a relationship as described below, as indicated in FIG. 4. It should be noted that TL(P16*a*) is a saturated liquid temperature calculated from a pressure that is detected by the high-pressure sensor 16 when the high-pressure sensor 16 is abnormal, and TG(P16*a*) is a saturated gas temperature calculated from the pressure that is detected by the high-pressure sensor 16 when the high-pressure sensor 16 is abnormal.

$$TL(P16a) = TG(P16a) < T(53n)$$

As described above, when the high-pressure sensor 16 is abnormal, a gas, which is a compressible fluid, mixes into oil part of the pressure sensor and serves as a buffer, thus reducing propagation of a pressure to the piezoelectric element. Consequently, a value lower than an actual pressure is detected. Thus, the saturated liquid temperature and the saturated gas temperature fall below the condenser outlet temperature. When the saturated liquid temperature or the saturated gas temperature falls below the condenser outlet temperature, it can be determined that the high-pressure sensor 16 is abnormal.

When the condenser-outlet-temperature sensor 53 is abnormal, T(53*a*) and T(54*n*) satisfy such a relationship as described below, as indicated in FIG. 5. It should be noted that T(53*a*) is a condenser outlet temperature that is detected by the condenser-outlet-temperature sensor 53 when the condenser-outlet-temperature sensor 53 is abnormal.

$$T(53a) < T(54n)$$

To be more specific, since refrigerant that flows in the condenser 12 exchanges heat with the ambient air of the condenser 12 and transfers heat to the ambient air, the condenser outlet temperature does not fall below the condenser ambient temperature, as long as the condenser-outlet-temperature sensor 53 is normal. Therefore, when the condenser outlet temperature falls below the condenser ambient temperature, it can be determined that the condenser-outlet-temperature sensor 53 is abnormal.

The flow of a control during a sensor-abnormality determination process in the refrigeration cycle apparatus 100 according to Embodiment 1 will be described.

Figure 6:
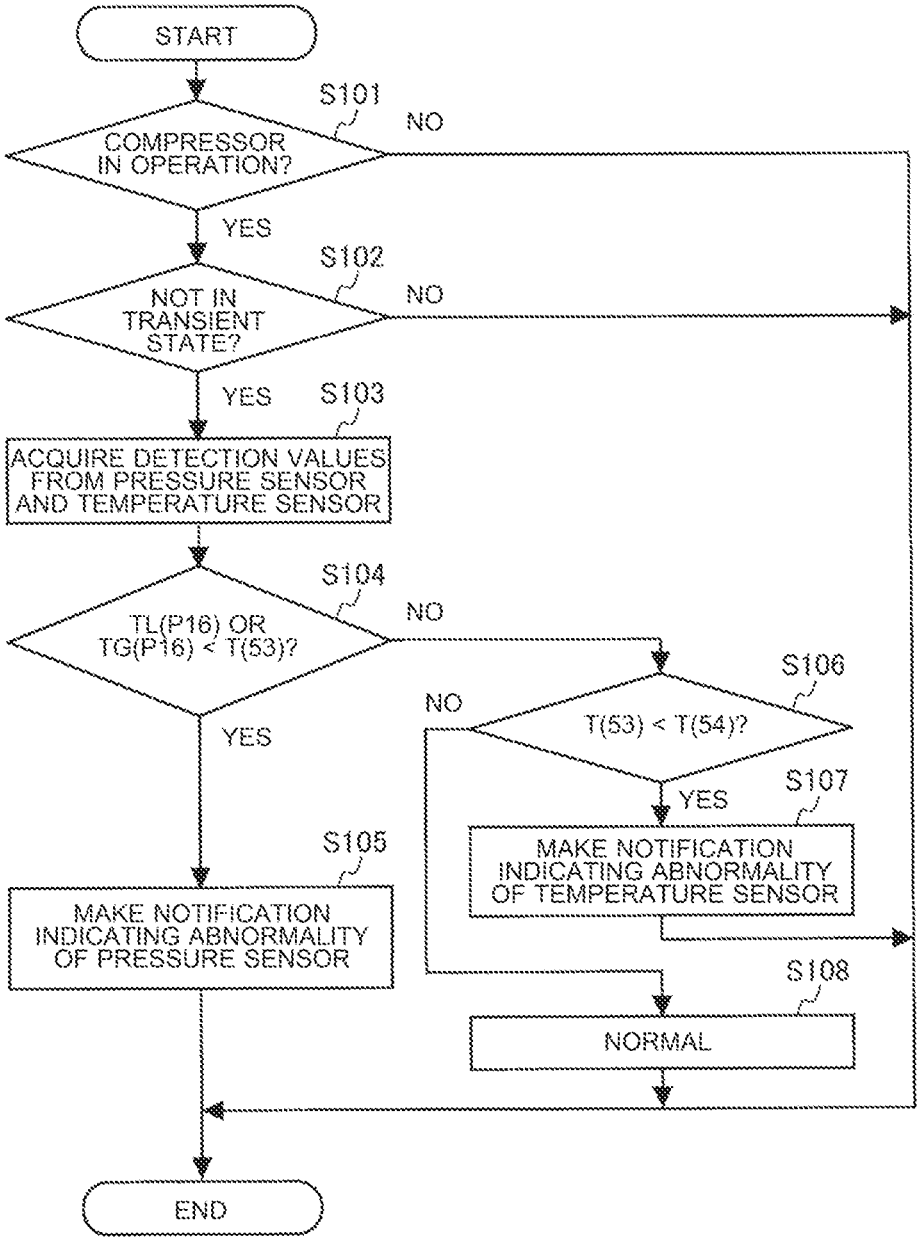
FIG. 6 is a flowchart indicating the flow of a control in a sensor-abnormality determination mode in the refrigeration cycle apparatus according to Embodiment 1.

FIG. 6 is a flowchart indicating the flow of a control in a sensor-abnormality determination mode in the refrigeration cycle apparatus 100 according to Embodiment 1. The controller 30 switches at regular intervals, the mode to be applied, from the normal operation mode to the sensor-abnormality determination mode, and executes an abnormality determination process as described below. Alternatively, the controller 30 switches the mode to be applied, from the normal operation mode to the sensor-abnormality determination mode, upon reception of a signal from the operation-mode switching module 37 that is operated by the user to switch the mode to the sensor-abnormality determination mode, and the controller 30 then executes the abnormality determination process described below.

(Step S101)

The controller 30 determines whether the compressor 11 is in operation or not. When the controller 30 determines that the compressor 11 is in operation (YES), the process by the controller 30 proceeds to step S102. By contrast, when the controller 30 determines that the compressor 11 is not in operation (NO), the controller 30 ends the sensor-abnormality determination process. This is because if the sensor-abnormality determination process is executed when the compressor 11 is not in operation, it is not possible to correctly detect a sensor abnormality that is an abnormality of a sensor. For this reason, the controller 30 ends the sensor-abnormality determination process when the compressor 11 is not in operation.

(Step S102)

The controller 30 determines whether or not the current state is not a transient state. It should be noted that the transient state is, for example, an unstable operational state, such as an operation state at the time when the compressor 11 starts, or that at the time when the opening degree of the expansion device 21 greatly varies, as a result of which the amount of liquid refrigerant stored on the high-pressure side varies. When the controller 30 determines that the current state is not the transient state (NO), the process by the controller 30 proceeds to step S103. By contrast, when the controller 30 determines that the current state is the transient state (YES), the controller 30 ends the sensor-abnormality determination process. This is because if the sensor-abnormality determination process is executed when the current state is the transient state, it is not possible to correctly detect the sensor abnormality. For this reason, the controller 30 ends the sensor-abnormality determination process when the current state is the transient state.

(Step S103)

The controller 30 acquires a detection value from the high-pressure sensor 16, and a detection value from the condenser-outlet-temperature sensor 53. It is not indispensable that step S103 is carried out after step S102. Step S103 may be carried out before step S101 or before step S102.

(Step S104)

The controller 30 determines whether or not TL(P16) or TG(P16)<T(53), that is, whether or not the saturated liquid temperature or the saturated gas temperature is lower than the condenser outlet temperature. When the controller 30 determines that the saturated liquid temperature or the saturated gas temperature is lower than the condenser outlet temperature (YES), the process by the controller 30 proceeds to step S105. By contrast, when the controller 30 determines that the saturated liquid temperature or the saturated gas temperature is not lower than the condenser outlet temperature (NO), the process by the controller 30 proceeds to step S106.

(Step S105)

The controller 30 determines that the high-pressure sensor 16 is abnormal, and causes the notifying module 36 to make a notification indicating that the high-pressure sensor 16 is abnormal.

(Step S106)

The controller 30 determines whether or not T(53)<T(54), that is, whether or not the condenser outlet temperature is lower than the condenser ambient temperature. When the controller 30 determines that the condenser outlet temperature is lower than the condenser ambient temperature (YES), the process by the controller 30 proceeds to step S107. By contrast, when the controller 30 determines that the condenser outlet temperature is not lower than the condenser ambient temperature (NO), the process by the controller 30 proceeds to step S108.

(Step S107)

The controller 30 determines that the condenser-outlet-temperature sensor 53 is abnormal, and causes the notifying module 36 to make a notification indicating that the condenser-outlet-temperature sensor 53 is abnormal.

(Step S108)

The controller 30 determines that the high-pressure sensor 16 and the condenser-outlet-temperature sensor 53 are normal, and ends the sensor-abnormality determination process.

Next, a modification of the refrigeration cycle apparatus 100 according to Embodiment 1 will be described.

In the refrigeration cycle apparatus 100 according to Embodiment 1, the refrigerant circuit 1 is sealed, with azeotropic refrigerant contained therein. In the modification of the refrigeration cycle apparatus 100 according to Embodiment 1, the refrigerant circuit 1 is sealed, with non-azeotropic refrigerant contained therein. Regarding the other configurations, the modification is the same as Embodiment 1.

Figure 7:
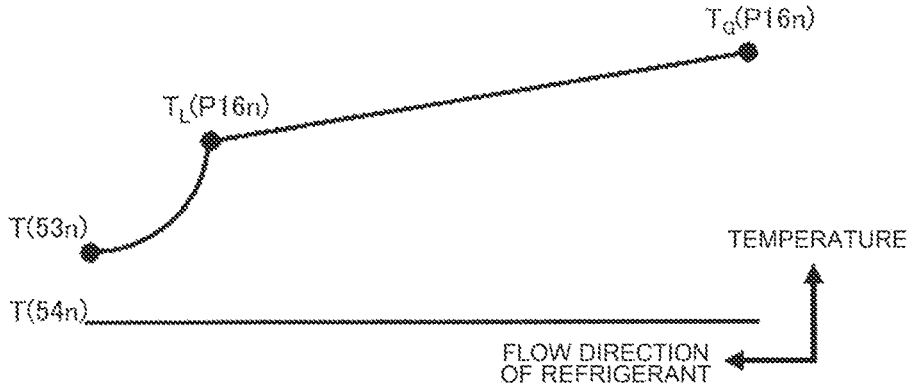
FIG. 7 indicates values that are detected by various sensors in a modification of the refrigeration cycle apparatus according to Embodiment 1 when the sensors are normal.
Figure 8:
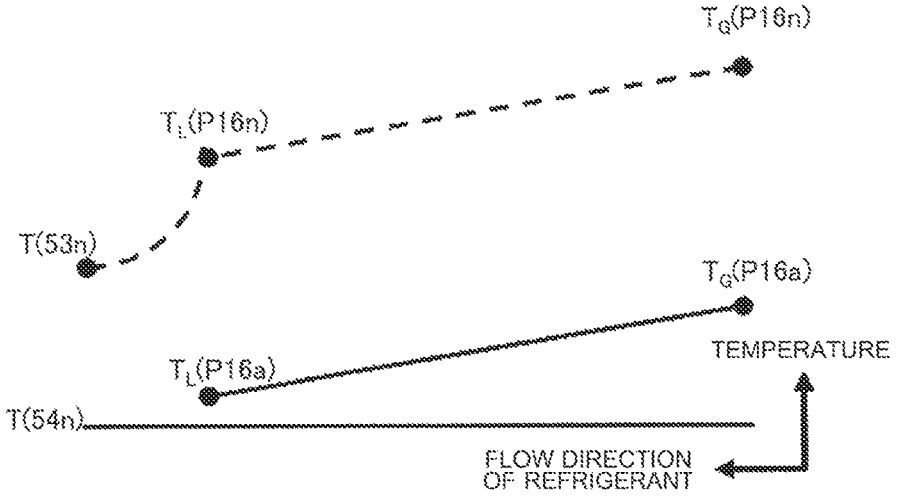
FIG. 8 indicates values that are detected by the various sensors in the modification of the refrigeration cycle apparatus according to Embodiment 1 when the pressure sensor are abnormal.
Figure 9:
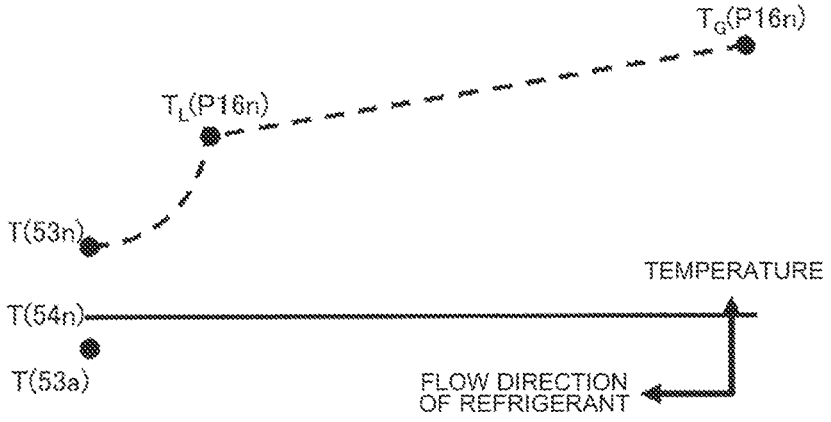
FIG. 9 indicates values that are detected by the various sensors in the modification of the refrigeration cycle apparatus according to Embodiment 1 when the first temperature sensor is abnormal.

FIG. 7 indicates values that are detected by various sensors in the modification of the refrigeration cycle apparatus 100 according to Embodiment 1 when the sensors are normal. FIG. 8 illustrates values that are detected by the various sensors in the modification of the refrigeration cycle apparatus 100 according to Embodiment 1 when the high-pressure sensor 16 are abnormal. FIG. 9 illustrates values that are detected by the various sensors in the modification of the refrigeration cycle apparatus 100 according to Embodiment when the condenser-outlet-temperature sensor 53 is abnormal.

When the values detected by the various sensors are normal, as indicated in FIG. 7, T(54*n*), T(53*n*), TL(P16*n*), and TG(P16*n*) satisfy the following relationship.

$$T(54n) \leq T(53n) \leq TL(P16n) \leq TG(P16n)$$

In the non-azeotropic refrigerant, its composition varies between the liquid phase and the gas phase, thereby causing a temperature gradient during phase change; and its saturated liquid temperature and its saturated gas temperature are different from each other.

When the high-pressure sensor 16 is abnormal, as indicated in FIG. 8, T(53*n*) and TL(P16*a*) satisfy the following relationship.

$$TL(P16a) < T(53n)$$

As described above, when the high-pressure sensor 16 is abnormal, a gas, which is a compressible fluid, mixes into the oil part of the pressure sensor and serves as a buffer, thereby reducing the propagation of a pressure to the piezoelectric element. Consequently, a value lower than an actual pressure is detected. Thus, the saturated liquid temperature falls below the condenser outlet temperature. Therefore, when the saturated liquid temperature becomes lower than the condenser outlet temperature, it can be determined that the high-pressure sensor 16 is abnormal.

When the condenser-outlet-temperature sensor 53 is abnormal, as indicated in FIG. 9, T(53*a*) and T(54*n*) satisfy the following relationship.

$$T(53a)<T(54n)$$

To be more specific, refrigerant that flows in the condenser 12 exchanges heat with the ambient air of the condenser 12 and transfers heat to the ambient air. Thus, as long as the condenser-outlet-temperature sensor 53 is normal, the condenser outlet temperature does not fall below the condenser ambient temperature. Therefore, when the condenser outlet temperature falls below the condenser ambient temperature, it can be determined that the condenser-outlet-temperature sensor 53 is abnormal.

The flow of the control during the sensor-abnormality determination process in the modification of the refrigeration cycle apparatus 100 according to Embodiment 1 is the same as that of Embodiment 1, and its description will thus be omitted.

As described above, the refrigeration cycle apparatus 100 according to Embodiment 1 includes the refrigerant circuit 1 in which the compressor 11, the condenser 12, the expansion device 21, and the evaporator 22 are connected by refrigerant pipes, and refrigerant circulates. The refrigeration cycle apparatus 100 also includes the high-pressure sensor 16 that detects the pressure on the discharge side of the compressor 11, and the first temperature sensor that detects the temperature of the refrigerant on the outlet side of the condenser 12. Furthermore, the refrigeration cycle apparatus 100 includes the controller 30 that determines that the high-pressure sensor 16 is abnormal, when the compressor 11 is in operation and the temperature detected by the first temperature sensor is higher than a saturated liquid temperature or a saturated gas temperature that is calculated from the pressure detected by the high-pressure sensor 16.

In the refrigeration cycle apparatus 100 according to Embodiment 1, it is determined that the high-pressure sensor 16 is abnormal, when the compressor 11 is in operation and the temperature detected by the first temperature sensor is higher than the saturated liquid temperature or the saturated gas temperature that is calculated from the pressure detected by the high-pressure sensor 16, or when the compressor 11 is in operation and the temperature detected by the first temperature sensor is higher than the saturated gas temperature that is calculated from the pressure detected by the high-pressure sensor 16. Therefore, in the case where the pressure sensor and the temperature sensor are provided, it is possible to determine occurrence of an abnormality in the pressure sensor when it occurs therein.

Moreover, the refrigeration cycle apparatus 100 according to Embodiment 1 includes the third temperature sensor that detects an ambient temperature of the condenser 12. The controller 30 determines that the first temperature sensor is abnormal, when the compressor 11 is in operation and the temperature detected by the third temperature sensor is higher than the temperature detected by the first temperature sensor.

In the refrigeration cycle apparatus 100 according to Embodiment 1, when the compressor 11 is in operation and the temperature detected by the third temperature sensor is higher than the temperature detected by the first temperature sensor, it is determined that the first temperature sensor is abnormal. Thus, in the case where the pressure sensor and the temperature sensor are provided, it is possible to determine occurrence of an abnormality in the temperature sensor when it occurs therein.

Furthermore, it is possible to determine which one of the pressure sensor and the temperature sensor is abnormal, regardless of whether the refrigerant used is azeotropic refrigerant or non-azeotropic refrigerant. Since it is possible to determine which one of the pressure sensor and the temperature sensor is abnormal, it is possible to avoid an erroneous determination in which the pressure sensor is erroneously determined abnormal even when the pressure sensor is not abnormal. Furthermore, since it is possible to determine which one of the pressure sensor and the temperature sensor is abnormal, it is possible to specify the cause of the abnormality, and early repair the abnormal sensor. As a result, it is possible to shorten the time for which the refrigeration cycle apparatus 100 is abnormal, and also shorten the time for which the refrigeration cycle apparatus 100 is operated in an abnormal condition.

When being abnormal, the pressure sensor detects a lower value than in normal condition, and as a result, the refrigeration cycle apparatus 100 is controlled at a higher pressure than in normal condition. If the refrigeration cycle apparatus 100 is controlled at such a higher pressure, the energy consumption of the compressor 11 increases, as a result of which the energy efficiency worsens and the operation is environmentally unfriendly. In view of this, in Embodiment 1, the sensor-abnormality determination is made as described above, to thereby shorten the time for which the operation is performed in abnormal condition. It is therefore possible to reduce a decrease in the lifetime of the refrigeration cycle apparatus 100, and also reduce an environmental load and a life cycle cost.

Embodiment 2

Regarding Embodiment 2, components that are the same as or equivalent to those in Embodiment 1 will be denoted by the same reference signs, and configurations, etc., that are the same as those in Embodiment 1 and have already been described regarding Embodiment 1 will not be re-described.

Figure 10:
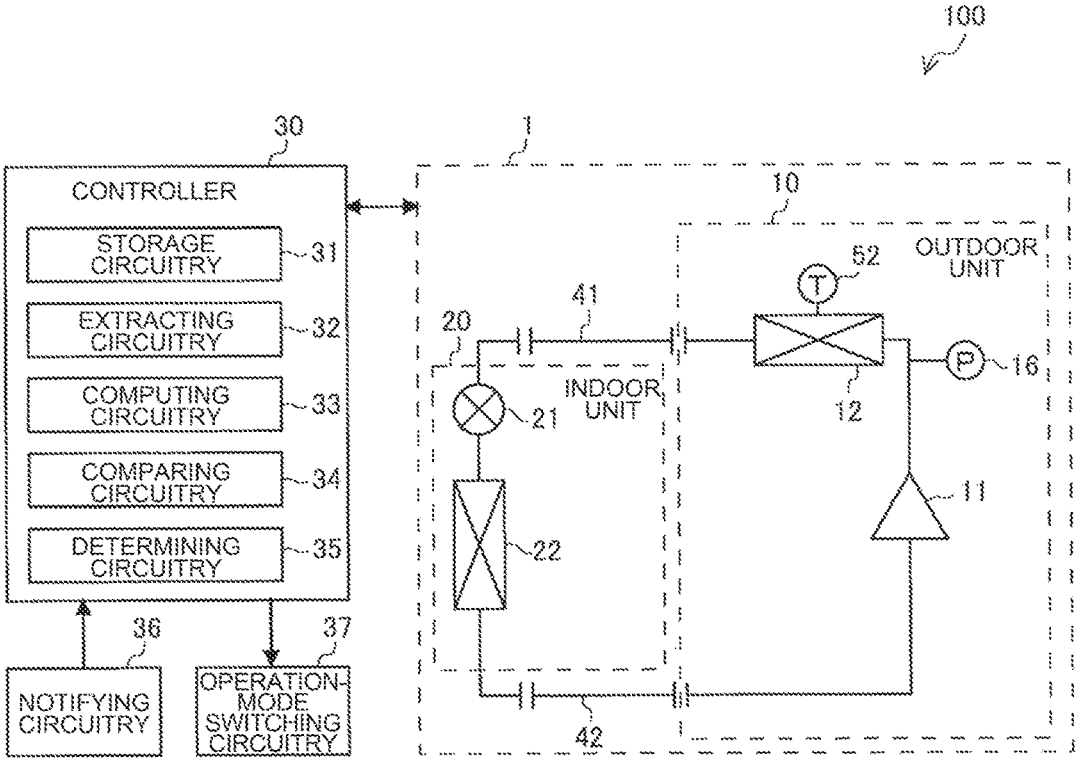
FIG. 10 illustrates a configuration of a refrigeration cycle apparatus according to Embodiment 2.

FIG. 10 illustrates a configuration of the refrigeration cycle apparatus 100 according to Embodiment 2.

In the refrigeration cycle apparatus 100 according to Embodiment 1, the condenser-outlet-temperature sensor 53 is provided between the condenser 12 and the expansion device 21. In contrast, the refrigeration cycle apparatus 100 according to Embodiment 2 includes a condenser-two-phase-part-temperature sensor 52 instead of the condenser-outlet-temperature sensor 53. The condenser-two-phase-part-temperature sensor 52 is located at a midway position of pipes included in the condenser 12. The condenser-two-phase-part-temperature sensor 52 detects the temperature T(52) of two-phase refrigerant that flows in the condenser 12 (which will be hereinafter referred to as two-phase refrigerant temperature), and then outputs a detection signal to the controller 30. Furthermore, in the refrigeration cycle apparatus 100 according to Embodiment 2, the refrigerant circuit 1 is sealed, with azeotropic refrigerant contained therein. The condenser-two-phase-part-temperature sensor 52 will be also hereinafter referred to as a second temperature sensor.

In Embodiment 2, the condenser-two-phase-part-temperature sensor 52 is installed as a temperature sensor at a position where the condenser-two-phase-part-temperature sensor 52 can detect the temperature of two-phase refrigerant that flows in the condenser 12, but the installation of the condenser-two-phase-part-temperature sensor 52 is not limited to the above installation. The condenser-two-phase-part-temperature sensor 52 may be installed at a position where the refrigerant that flows in the condenser 12 is in a saturated liquid state.

In Embodiment 1, it cannot be determined whether or not the high-pressure sensor 16 is abnormal, until the saturated liquid temperature or the saturated gas temperature that is calculated from the pressure detected by the high-pressure sensor 16 falls below a condenser outlet temperature in which the degree of subcooling is secured. It is thus necessary to wait for a condition in which the saturated liquid temperature or the saturated gas temperature falls below the condenser outlet temperature in which the degree of subcooling is secured. This means that a waiting time is required for the sensor-abnormality determination. By contrast, in Embodiment 2, the condenser-two-phase-part-temperature sensor 52 is provided at a position where the condenser-two-phase-part-temperature sensor 52 can detect the temperature of two-phase refrigerant that flows in the condenser 12. Thus, it is not necessary to wait for a condition in which the saturated liquid temperature or the saturated gas temperature falls below the condenser outlet temperature in which the degree of subcooling is secured. Therefore, the sensor abnormality determination can be made based on the two-phase refrigerant temperature and the saturated liquid temperature or the saturated gas temperature. As a result, in Embodiment 2, it is possible to earlier make the sensor abnormality determination than in Embodiment 1.

Next, it will be described what are the causes of occurrence of an abnormality in each of the pressure sensor and the temperature sensor.

A cause of occurrence of an abnormality in the pressure sensor is the same as that in Embodiment 1. To be more specific, one of causes of occurrence of an abnormality in the temperature sensor is the same as that in Embodiment 1 and the other can be considered to be the following cause.

In order for the condenser-two-phase-part-temperature sensor 52 to detect a two-phase refrigerant temperature as accurately as possible without being affected by the ambient air of the condenser 12, the condenser-two-phase-part-temperature sensor 52 is brought into close contact with the pipes included in the condenser 12, and a heat insulation material is provided at part of the condenser-two-phase-part-temperature sensor 52 that is in contact with the ambient air of the condenser 12. However, if the heat insulation material deteriorates and is detached from the above part, the condenser-two-phase-part-temperature sensor 52 may be affected by the ambient air of the condenser 12, whereby a detection value detected by the sensor can be considered to lower to a value lower than that in normal condition. Although it depends on the state of the above deterioration, the detection value lowers from that detected in normal condition due to an increase in the contact area with the ambient air whose temperature is lower than the two-phase refrigerant temperature. Therefore, in the related art, it is hard to perform abnormality detection.

Figure 11:
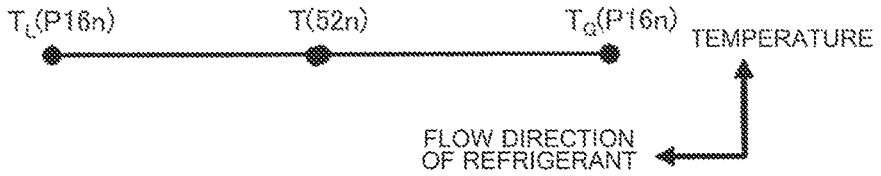
FIG. 11 indicates values that are detected by various sensors in the refrigeration cycle apparatus according to Embodiment 2 when the sensors are normal.
Figure 12:
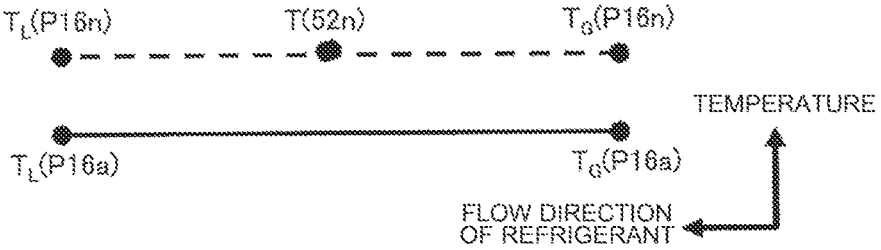
FIG. 12 indicates values that are detected by the various sensors in the refrigeration cycle apparatus according to Embodiment 2 when the pressure sensor is abnormal.
Figure 13:
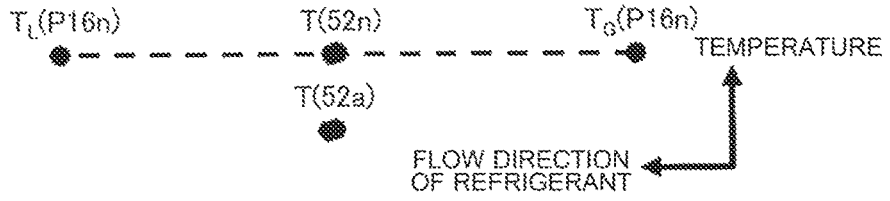
FIG. 13 illustrates values that are detected by the various sensors of the refrigeration cycle apparatus according to Embodiment 2 when the first temperature sensor is abnormal.

FIG. 11 indicates values that are detected by various sensors of the refrigeration cycle apparatus 100 according to Embodiment 2 when the sensors are normal. FIG. 12 indicates values that are detected by the various sensors of the refrigeration cycle apparatus 100 according to Embodiment 2 when the high-pressure sensor 16 is abnormal. FIG. 13 indicates values that are detected by the various sensors of the refrigeration cycle apparatus 100 according to Embodiment 2 when the first temperature sensor is abnormal.

When the values detected by the various sensors are normal, as indicated in FIG. 11, T(52*n*), TL(P16*n*), and TG(P16*n*) satisfies such a relationship as described below, where T(52*n*) is a two-phase refrigerant temperature that is detected by the condenser-two-phase-part-temperature sensor 52 when the condenser-two-phase-part-temperature sensor 52 is normal, TL(P16*n*) is a saturated liquid temperature calculated from a pressure that is detected by the high-pressure sensor 16 when the high-pressure sensor 16 is normal, and TG(P16*n*) is a saturated gas temperature calculated from the pressure that is detected by the high-pressure sensor 16 when the high-pressure sensor 16 is normal.

$$TL(P16n)=T(52n)=TG(P16n)$$

When the high-pressure sensor 16 is abnormal, as indicated in FIG. 12, T(52*n*), TL(P16*a*), and TG(P16*a*) satisfy such a relationship as described below, where TL(P16*a*) is a saturated liquid temperature calculated from a pressure that is detected by the high-pressure sensor 16 when the high-pressure sensor 16 is abnormal, and TG(P16*a*) is a saturated gas temperature calculated from the pressure that is detected by the high-pressure sensor 16 when the high-pressure sensor 16 is abnormal.

$$TG(P16a)<T(52n) \text{ or } TL(P16a)<T(52n)$$

As described above, when the high-pressure sensor 16 is abnormal, a gas, which is a compressible fluid, mixes into the oil part of the pressure sensor and serves as a buffer, thereby reducing propagation of a pressure to the piezoelectric element. As a result, a value lower than an actual pressure is detected. Thus, the saturated liquid temperature and the saturated gas temperature fall below the two-phase refrigerant temperature, and it is possible to determine that the high-pressure sensor 16 is abnormal, when the saturated liquid temperature or the saturated gas temperature falls below the two-phase refrigerant temperature.

When the condenser-two-phase-part-temperature sensor 52 is abnormal, as indicated in FIG. 13, T(52*a*), TL(P16*n*), and TG(P16*n*) satisfy such a relationship as described below, where T(52*a*) is a two-phase refrigerant temperature that is detected by the condenser-two-phase-part-temperature sensor 52 when the condenser-two-phase-part-temperature sensor 52 is abnormal.

$$T(52a)<TG(P16n), \text{ or } T(52a)<TL(P16n)$$

When the condenser-two-phase-part-temperature sensor 52 is normal, the temperature detected by the condenser-two-phase-part-temperature sensor 52 is equal to the saturated liquid temperature and the saturated gas temperature. Therefore, when the temperature detected by the condenser-two-phase-part-temperature sensor 52 falls below the saturated liquid temperature or the saturated gas temperature, it can be determined that the condenser-two-phase-part-temperature sensor 52 is abnormal.

The flow of a control during a sensor-abnormality determination process in the refrigeration cycle apparatus 100 according to Embodiment 2 will be described.

Figure 14:
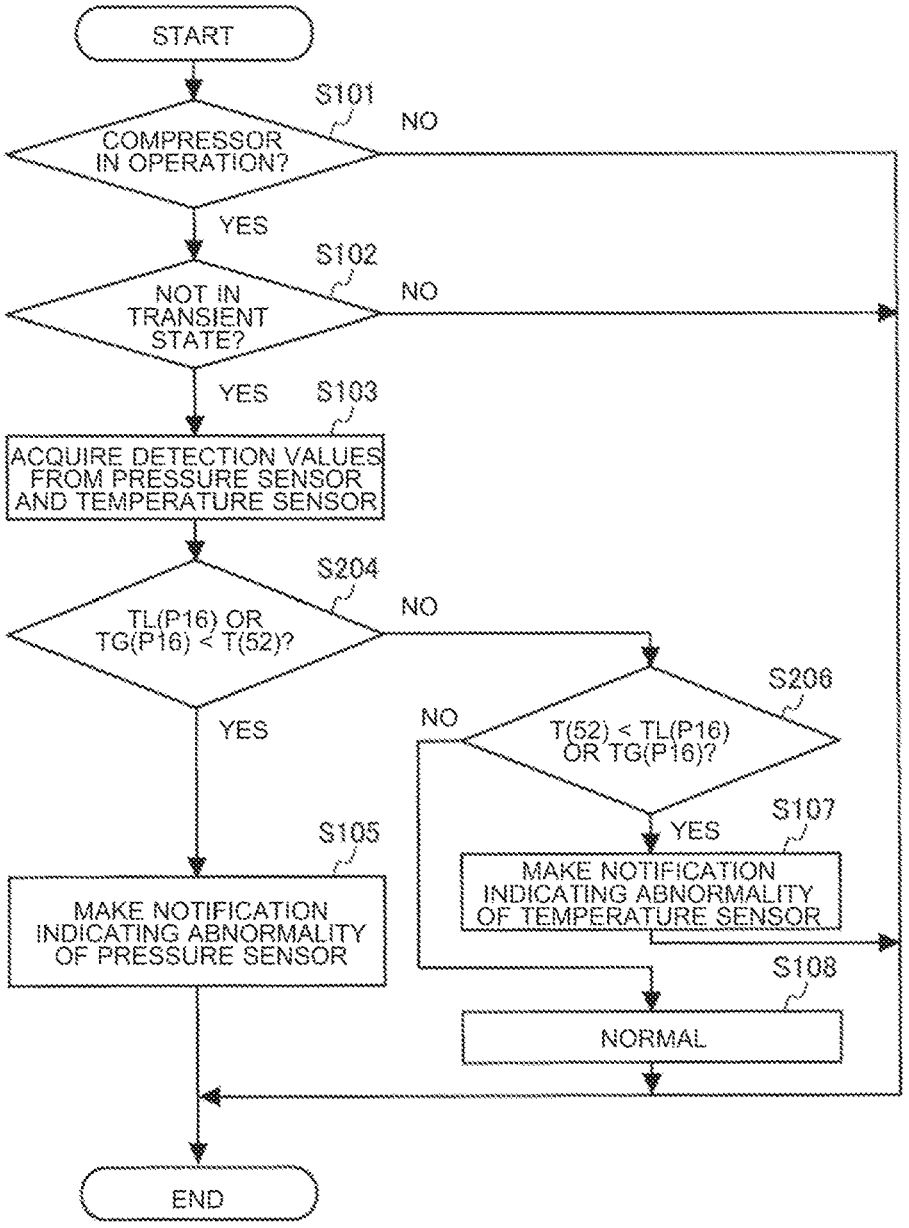
FIG. 14 is a flowchart indicating a control in sensor-abnormality determination mode by the refrigeration cycle apparatus according to Embodiment 2.

FIG. 14 is a flowchart indicating the flow of a control in a sensor-abnormality determination mode in the refrigeration cycle apparatus 100 according to Embodiment 2.

The controller 30 switches the mode to be applied, from the normal operation mode to the sensor-abnormality determination mode at regular intervals, and executes an abnormality determination process as described below. Alternatively, the controller 30 switches the mode from the normal operation mode to the sensor-abnormality determination mode, upon reception of a signal from the operation-mode switching module 37 that is operated by the user to switch the mode to the sensor-abnormality determination mode, and executes an abnormality determination process described below.

Steps S101 to S103, S105, and S108 are the same as those as described above, and their descriptions will thus be omitted. However, regarding step S103 as indicated in FIG. 14, "proceeds to step S104" in the previous description concerning step S103 should read "proceeds to step S204," and regarding steps S107 and S108 as indicated in FIG. 14, "condenser-outlet-temperature sensor 53" in the previous description concerning steps S107 and S108 should read "condenser-two-phase-part-temperature sensor 52."

(Step S204)

The controller 30 determines whether or not TL(P16) or TG(P16)<T(52), that is, whether or not the saturated liquid temperature or the saturated gas temperature is lower than the two-phase refrigerant temperature. When the controller 30 determines that the saturated liquid temperature or the saturated gas temperature is lower than the two-phase refrigerant temperature (YES), the process by the controller 30 proceeds to step S105. By contrast, when the controller 30 determines that the saturated liquid temperature or the saturated gas temperature is not lower than the two-phase refrigerant temperature (NO), the process by the controller 30 proceeds to step S206.

(Step S206)

The controller 30 determines or not whether T(52)<TL (P16) or TG(P16), that is, whether or not the two-phase refrigerant temperature is lower than the saturated liquid temperature or the saturated gas temperature. When the controller 30 determines that the two-phase refrigerant temperature is lower than the saturated liquid temperature or the saturated gas temperature (YES), the process by the controller 30 proceeds to step S107. By contrast, when the controller 30 determines that the two-phase refrigerant temperature is not lower than the saturated liquid temperature or the saturated gas temperature (NO), the process by the controller 30 proceeds to step S108.

Next, a modification of the refrigeration cycle apparatus 100 according to Embodiment 2 will be described.

In the refrigeration cycle apparatus 100 according to Embodiment 2, the refrigerant circuit 1 is sealed, with azeotropic refrigerant contained therein. By contrast, in the modification of the refrigeration cycle apparatus 100 according to Embodiment 2, the refrigerant circuit 1 is sealed, with non-azeotropic refrigerant contained therein. The other configurations of the modification are the same as those of Embodiment 2.

Figure 15:
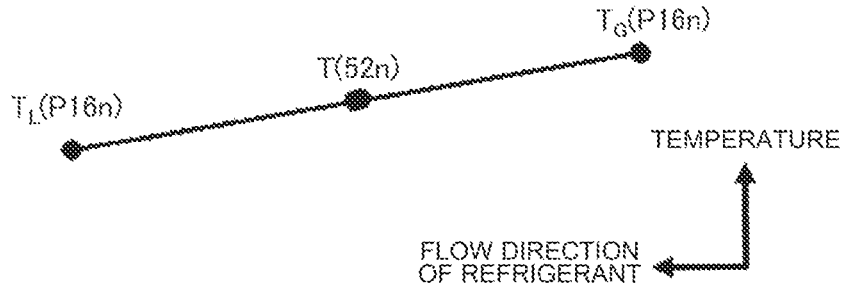
FIG. 15 illustrates values that are detected by various sensors in a modification of the refrigeration cycle apparatus according to Embodiment 2 when the sensors is normal.
Figure 16:
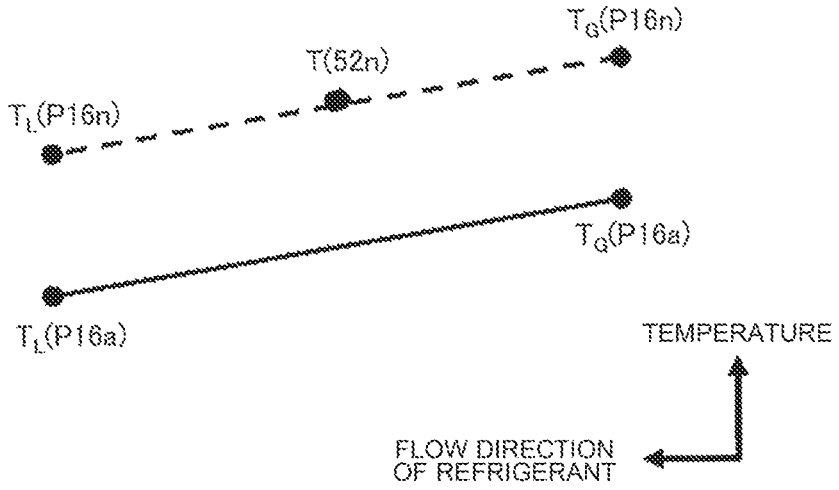
FIG. 16 illustrates values that are detected by the various sensors in the modification of the refrigeration cycle apparatus according to Embodiment 2 when the pressure sensor is abnormal.
Figure 17:
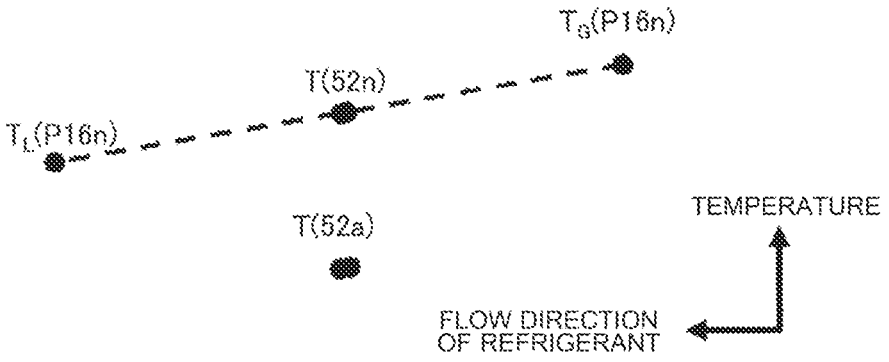
FIG. 17 illustrates values that are detected by the various sensors in the modification of the refrigeration cycle apparatus according to Embodiment 2 when the first temperature sensor is abnormal.

FIG. 15 indicates values that are detected by various sensors in the modification of the refrigeration cycle apparatus 100 according to Embodiment 2 when the sensors are normal. FIG. 16 indicates values that are detected by the various sensors in the modification of the refrigeration cycle apparatus 100 according to Embodiment 2 when the high-pressure sensor 16 is abnormal. FIG. 17 indicates values that are detected by the various sensors in the modification of the refrigeration cycle apparatus 100 according to Embodiment 2 when the condenser-two-phase-part-temperature sensor 52 is abnormal.

When the values detected by the various sensors are normal, as indicated in FIG. 15, T(52*n*), TL(P16*n*), and TG(P16*n*) satisfy the following relationship.

$$TL(P16n) \leq T(52n) \leq TG(P16n)$$

In the non-azeotropic refrigerant, its composition varies between the liquid phase and the gas phase, thus causing a temperature gradient during phase change, and its saturated liquid temperature and its saturated gas temperature are thus different from each other. Furthermore, the non-azeotropic refrigerant decreases in temperature as the refrigerant changes from the gas phase to the liquid phase. Thus, the above relationship is established.

When the high-pressure sensor 16 is abnormal, as indicated in FIG. 16, T(52*n*) and TG(P16*a*) satisfy the following relationship.

$$TG(P16a) < T(52n)$$

To be more specific, as described above, when the high-pressure sensor 16 is abnormal, a gas, which is a compressible fluid, mixes into the oil part of the pressure sensor and serves as a buffer, thereby reducing propagation of a pressure to the piezoelectric element. As a result, a value lower than the actual value is detected, and the saturated gas temperature thus falls below the two-phase refrigerant temperature. Therefore, when the saturated gas temperature falls below the two-phase refrigerant temperature, it can be determined that the high-pressure sensor 16 is abnormal.

When the condenser-two-phase-part-temperature sensor 52 is abnormal, as indicated in FIG. 17, T(52*a*) and TL(P16*n*) satisfy the following relationship.

$$T(52a) < TL(P16n)$$

To be more specific, a non-azeotropic refrigerant decreases in temperature as the refrigerant changes from the gas phase to the liquid phase. Thus, as long as the condenser-two-phase-part-temperature sensor 52 is normal, the two-phase refrigerant temperature does not fall below the saturated liquid temperature. Therefore, when the two-phase refrigerant temperature falls below the saturated liquid temperature, it can be determined that the phase-part-temperature sensor 52 is abnormal.

The flow of the control during the sensor-abnormality determination process in the modification of the refrigeration cycle apparatus 100 according to Embodiment 2 is the same as that in Embodiment 2, and its description will thus be omitted.

As described above, the refrigeration cycle apparatus 100 according to Embodiment 2 includes the refrigerant circuit 1 in which the compressor 11, the condenser 12, the expansion device 21, and the evaporator 22 are connected by refrigerant pipes, and refrigerant circulates. The refrigeration cycle apparatus 100 also includes the high-pressure sensor 16 that detects a pressure on a discharge side of the compressor 11 and the second temperature sensor that detects a temperature of the refrigerant that is in a saturated liquid state or a two-phase state. Furthermore, the refrigeration cycle apparatus 100 includes the controller 30 that determines that the high-pressure sensor 16 is abnormal, when the compressor 11 is in operation and the temperature detected by the second temperature sensor is higher than a saturated gas temperature calculated from the pressure detected by the high-pressure sensor 16.

In the refrigeration cycle apparatus 100 according to Embodiment 2, when the compressor 11 is in operation and the temperature detected by the second temperature sensor is higher than a saturated gas temperature calculated from the pressure detected by the high-pressure sensor 16, it is determined that the high-pressure sensor 16 is abnormal. Therefore, in the case where the pressure sensor and the temperature sensor are provided, it is possible to determine occurrence of an abnormality in the temperature sensor when it occurs therein.

In the refrigeration cycle apparatus 100 according to Embodiment 2, the controller 30 determines that the second temperature sensor is abnormal, when the compressor 11 is in operation and the saturated gas temperature calculated from the pressure detected by the high-pressure sensor 16 is higher than the temperature detected by the second temperature sensor. Therefore, in the case where the pressure sensor and the temperature sensor are provided, it is possible to determine that the temperature sensor is abnormal.

In the refrigeration cycle apparatus 100 according to Embodiment 2, when the compressor 11 is in operation and the saturated gas temperature calculated from the pressure detected by the high-pressure sensor 16 is higher than the temperature detected by the second temperature sensor, it is determined that the second temperature sensor is abnormal. Therefore, in the case where the pressure sensor and the temperature sensor are provided, it is possible to determine occurrence of an abnormality in the temperature sensor when it occurs therein.

Furthermore, it is possible to determine which one of the pressure sensor and the temperature sensor is abnormal, regardless of whether the refrigerant used is azeotropic refrigerant or non-azeotropic refrigerant. Since it is possible to determine which one of the pressure sensor and the temperature sensor is abnormal, it is also possible to avoid an erroneous determination in which the pressure sensor is erroneously determined abnormal even when the pressure sensor is not abnormal. Furthermore, since it is possible to determine which one of the pressure sensor and the temperature sensor is abnormal, it is also possible to specify the cause of the abnormality, and early repair the abnormal sensor. As a result, it is possible to shorten the time for which the refrigeration cycle apparatus 100 is abnormal and in addition shorten the time for which the refrigeration cycle apparatus 100 is operated in abnormal condition.

When the pressure sensor is abnormal, the pressure sensor detects a value lower than that detected in normal condition, and as a result, the refrigeration cycle apparatus 100 is controlled at a higher pressure than in normal condition. If the refrigeration cycle apparatus 100 is controlled at such a higher pressure, the energy consumption of the compressor 11 increases. Consequently, the energy efficiency worsens and an environmentally unfriendly operation is performed. In view of this, by performing the sensor-abnormality determination as described above regarding Embodiment 2, it is possible to reduce the time for which the operation is performed in abnormal condition. It is therefore possible to reduce a decrease in the lifetime of the refrigeration cycle apparatus 100, thus reducing an environmental load and a life cycle cost.

Embodiment 3

Regarding Embodiment 3, components that are the same as or equivalent to those in Embodiment 1 will be denoted by the same reference signs, and configurations, etc., that are the same as those in Embodiment 1 and have already been described regarding Embodiment 1 will not be re-described.

Figure 18:
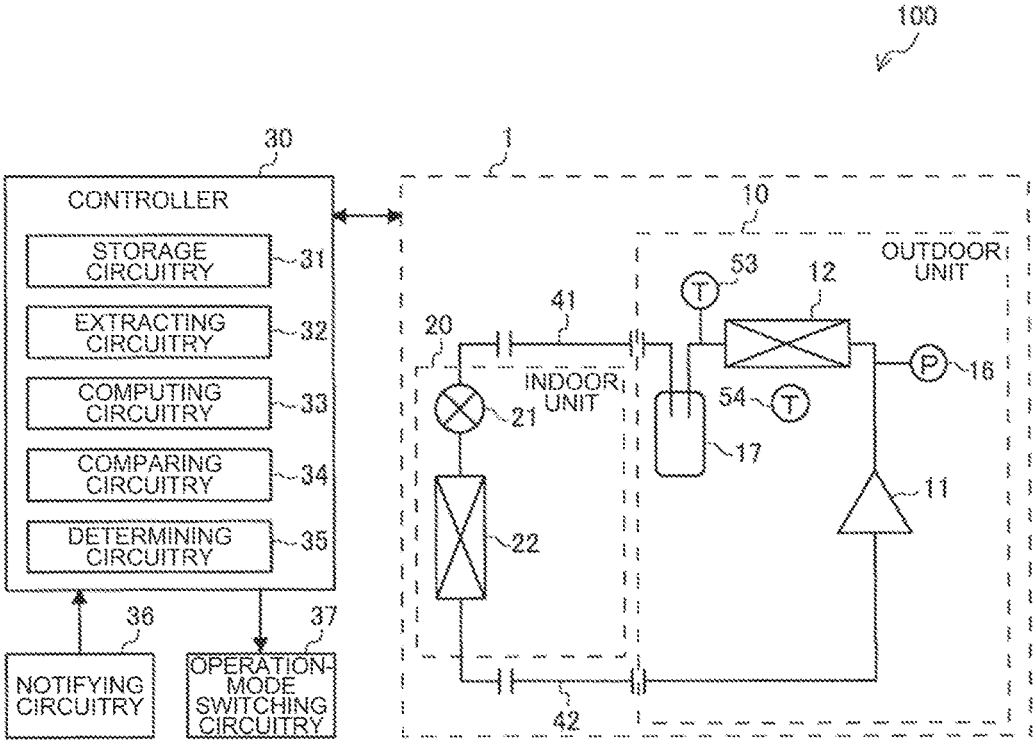
FIG. 18 illustrates a configuration of a refrigeration cycle apparatus according to Embodiment 3.

FIG. 18 illustrates a configuration of the refrigeration cycle apparatus 100 according to Embodiment 3.

In the refrigeration cycle apparatus 100 according to Embodiment 3, a liquid reservoir 17 is provided between the condenser 12 and the expansion device 21. Because of the presence of the liquid reservoir 17 between the condenser 12 and the expansion device 21, the refrigerant is in a saturated liquid state at the outlet of the condenser 12 at all times.

In Embodiment 1, it cannot be determined whether the high-pressure sensor 16 is abnormal or not, until a saturated liquid temperature or a saturated gas temperature that is calculated from a pressure detected by the high-pressure sensor 16 falls below a condenser outlet temperature in which the degree of subcooling is secured. It is thus necessary to wait for a condition in which the saturated liquid temperature or the saturated gas temperature falls below the condenser outlet temperature in which the degree of subcooling is secured. That is, a waiting time is required for sensor-abnormality determination. In contrast, in Embodiment 3, the refrigerant is in a saturated liquid state at the outlet of the condenser 12 at all times. It is therefore unnecessary to wait for a condition in which the saturated liquid temperature or the saturated gas temperature falls below the condenser outlet temperature in which the degree of subcooling is secured. Thus, the sensor abnormality determination can be made based on the saturated liquid temperature or the saturated gas temperature and the condenser outlet temperature. As a result, in Embodiment 3, it is possible to earlier make the sensor abnormality determination than in Embodiment 1.

Although in Embodiment 3, the condenser-outlet-temperature sensor 53 is located on the inlet side of the liquid reservoir 17 as illustrated in FIG. 18, the location of the condenser-outlet-temperature sensor 53 is not limited to that location, and the condenser-outlet-temperature sensor 53 may be provided on the outlet side of the liquid reservoir 17.

As described above, the refrigeration cycle apparatus 100 according to Embodiment 3 includes the liquid reservoir 17 provided between the condenser 12 and the expansion device 21. In the refrigeration cycle apparatus 100 according to Embodiment 3, because of the presence of the liquid reservoir 17 between the condenser 12 and the expansion device 21, the refrigerant on the outlet of the condenser 12 can be made in a saturated liquid state at all times. As a result, the sensor abnormality determination can be early made.

Embodiment 4

Regarding Embodiment 4, components that are the same as or equivalent to those in Embodiment 1 will be denoted by the same reference signs, and configurations, etc., that are the same as those in Embodiment 1 and have already been described regarding Embodiment 1 will not be re-described.

Figure 19:
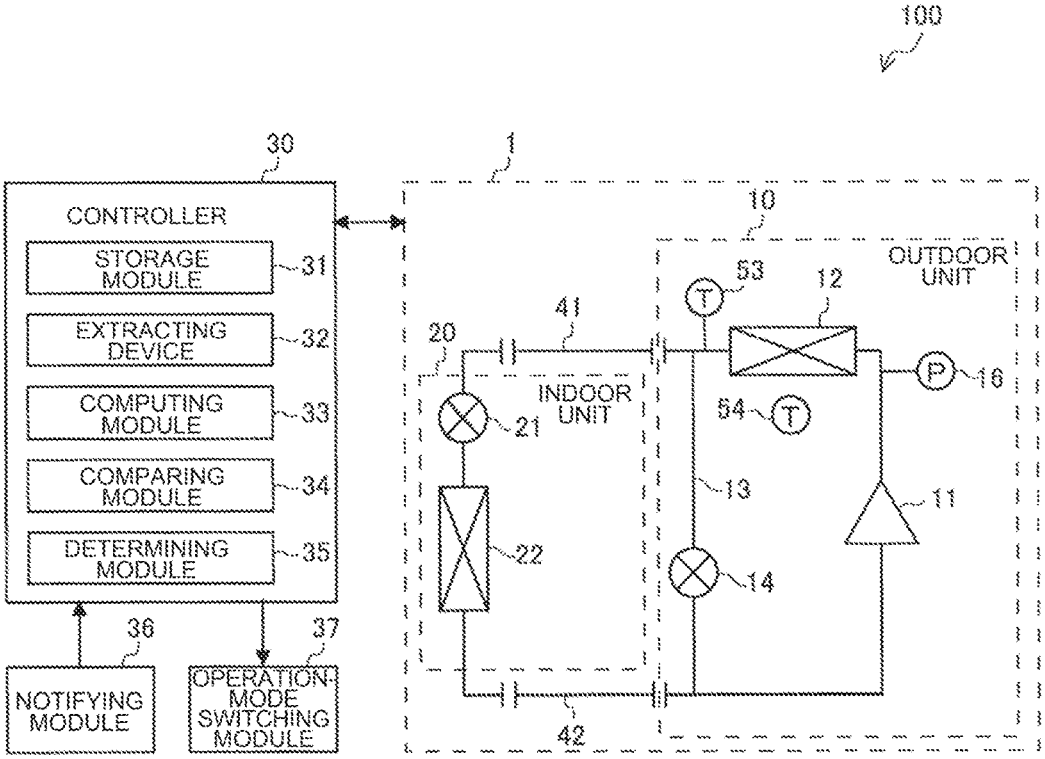
FIG. 19 illustrates a configuration of a refrigeration cycle apparatus according to Embodiment 4.

FIG. 19 illustrates a configuration of the refrigeration cycle apparatus 100 according to Embodiment 4.

The refrigeration cycle apparatus 100 according to Embodiment 4 includes a bypass pipe 13. The bypass pipe 13 connects a pipe between the condenser 12 and the expansion device 21 to a pipe between the evaporator 22 and the compressor 11. At the bypass pipe 13, a bypass valve 14 is provided. To be more specific, the bypass pipe 13 and the bypass valve 14 are provided, and by causing the bypass valve 14 to be in an opened state, the refrigerant at the outlet of the condenser 12 is in a two-phase state or a saturated liquid state at all times.

In Embodiment 1, it cannot be determined whether or not the high-pressure sensor 16 is abnormal, until a saturated liquid temperature or a saturated gas temperature that is calculated from the pressure detected by the high-pressure sensor 16 falls below a condenser outlet temperature in which the degree of subcooling is secured. It is therefore necessary to wait for a condition in which the saturated liquid temperature or the saturated gas temperature falls below the condenser outlet temperature in which the degree of subcooling is secured. That is, a waiting time is required for the sensor-abnormality determination. In contrast, in Embodiment 4, the refrigerant at the outlet of the condenser 12 is in a two-phase state or a saturated liquid state at all times. Thus, it is not necessary to wait for a condition in which the saturated liquid temperature or the saturated gas temperature falls below the condenser outlet temperature in which the degree of subcooling is secured, and the sensor abnormality determination can be made based on the saturated liquid temperature or the saturated gas temperature and the condenser outlet temperature. As a result, in Embodiment 4, it is possible to earlier make the sensor abnormality determination than in Embodiment 1.

Although in Embodiment 4, the condenser-outlet-temperature sensor 53 is located upstream of the inlet of the bypass pipe 13 as illustrated in FIG. 19, the location of the condenser-outlet-temperature sensor 53 is not limited to that location, and the condenser-outlet-temperature sensor 53 may be located downstream of the inlet of the bypass pipe 13.

Next, the flow of a control during a sensor-abnormality determination process in the refrigeration cycle apparatus 100 according to Embodiment 4 will be described.

Figure 20:
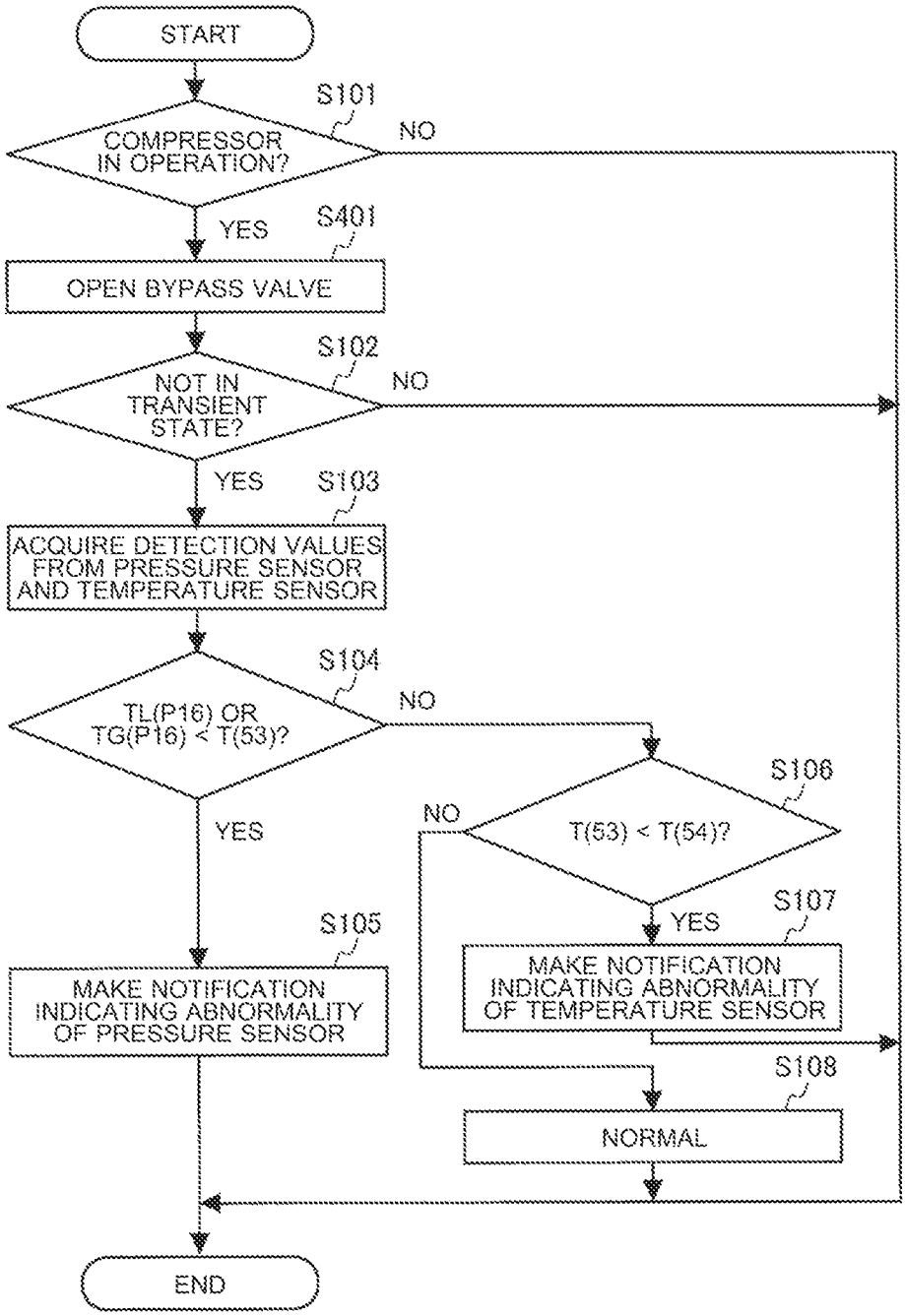
FIG. 20 is a flowchart indicating the flow of a control in a sensor-abnormality determination mode in the refrigeration cycle apparatus according to Embodiment 4.

FIG. 20 is a flowchart indicating a control in the sensor-abnormality determination mode in the refrigeration cycle apparatus 100 according to Embodiment 4.

The controller 30 switches the mode to be applied, from the normal operation mode to the sensor-abnormality determination mode, and executes an abnormality determination process as described below. Alternatively, upon reception of a signal from the operation-mode switching module 37 that is operated by the user to switch the mode to the sensor-abnormality detection mode, the controller 30 switches the mode from the normal operation mode to the sensor-abnormality determination mode, and executes the abnormality determination process described below.

Steps S101 to S108 are the same as those in the above description, and their descriptions will thus be omitted. However, regarding step S101 as indicated in FIG. 20, "proceeds to step S102" in the previous description concerning step S101 should read "proceeds to step S401." Furthermore, regarding step S103 as indicated in FIG. 20, "may be performed before step S101 or before step S102" in the previous description concerning step S103 should read "may be performed before step S101, before step S401, or before step S102."

(Step S401)

The controller 30 causes the bypass valve 14 to be in the opened state.

In the case where the bypass valve 14 is caused to be in the opened state, the controller 30 causes the bypass valve 14 to be in a closed state after the sensor-abnormality determination process ends.

As described above, the refrigeration cycle apparatus 100 according to Embodiment 4 includes the bypass pipe 13 that connects a location between the condenser 12 and the expansion device 21 and a location between the evaporator 22 and the compressor 11, and the bypass valve 14 provided at the bypass pipe 13.

In the refrigeration cycle apparatus 100 according to Embodiment 4, the bypass valve 14 is provided at the bypass pipe 13 which connects the location between the condenser 12 and the expansion device 21 and the location between the evaporator 22 and the compressor 11, and the bypass valve 14 is caused to be in the opened state, whereby the refrigerant at the outlet of the condenser 12 can be always in a two-phase state or a saturated liquid state. As a result, the sensor abnormality determination can be made early.

REFERENCE SIGNS LIST

1: refrigerant circuit, 10: outdoor unit, 11: compressor, 12: condenser, 13: bypass pipe, 14: bypass valve, 16: high-pressure sensor, 17: liquid reservoir, 20: indoor unit, 21: expansion device, 22: evaporator, 30: controller, 31: storage module, 32: extracting module, 33: computing module, 34: comparing module, 35: determining module, 36: notifying module, 37: operation-mode switching module, 41: liquid pipe, 42: gas pipe, 52: condenser-two-phase-part-temperature sensor, 53: condenser-outlet-temperature sensor, 54: condenser-ambient-temperature sensor, 100: refrigeration cycle apparatus

The invention claimed is:

1. A refrigeration cycle apparatus comprising:

a refrigerant circuit in which a compressor, a condenser, an expansion device, and an evaporator are connected by pipes, and refrigerant circulates;

a high-pressure sensor configured to detect a pressure of the refrigerant on a discharge side of the compressor;

a first temperature sensor configured to detect a temperature of the refrigerant on an outlet side of the condenser; and a controller configured to determine that the high-pressure sensor is abnormal, when the compressor is in operation and the temperature detected by the first temperature sensor is higher than a saturated liquid temperature or a saturated gas temperature that is calculated from the pressure detected by the high-pressure sensor.

2. A refrigeration cycle apparatus comprising:

a refrigerant circuit in which a compressor, a condenser, an expansion device, and an evaporator are connected by pipes, and refrigerant circulates;

a high-pressure sensor configured to detect a pressure of the refrigerant on a high-pressure side of the compressor;

a temperature sensor configured to detect a temperature of the refrigerant which is in a saturated liquid state or a two-phase state; and a controller configured to determine that the high-pressure sensor is abnormal, when the compressor is in operation and the temperature detected by the temperature sensor is higher than a saturated gas temperature calculated from the pressure detected by the high-pressure sensor.

3. The refrigeration cycle apparatus of claim 1, further comprising:

an additional temperature sensor configured to detect an ambient temperature of the condenser, wherein the controller is configured to determine that the first temperature sensor is abnormal when the compressor is in operation and the temperature detected by the additional temperature sensor is higher than the temperature detected by the first temperature sensor.

4. The refrigeration cycle apparatus of claim 2, wherein the controller is configured to determine that the temperature sensor is abnormal, when the compressor is in operation and the saturated gas temperature calculated from the pressure detected by the high-pressure sensor is higher than the temperature detected by the temperature sensor.

5. The refrigeration cycle apparatus of claim 1, further comprising a liquid reservoir provided between the condenser and the expansion device.

6. The refrigeration cycle apparatus of claim 1, further comprising:

a bypass pipe that connects a location between the condenser and the expansion device and a location between the evaporator and the compressor; and a bypass valve provided at the bypass pipe.

7. The refrigeration cycle apparatus of claim 2, further comprising a liquid reservoir provided between the condenser and the expansion device.

8. The refrigeration cycle apparatus of claim 2, further comprising:

a bypass pipe that connects a location between the condenser and the expansion device and a location between the evaporator and the compressor; and a bypass valve provided at the bypass pipe.

9. The refrigeration cycle apparatus of claim 3, further comprising a liquid reservoir provided between the condenser and the expansion device.

10. The refrigeration cycle apparatus of claim 3, further comprising:

a bypass pipe that connects a location between the condenser and the expansion device and a location between the evaporator and the compressor; and a bypass valve provided at the bypass pipe.

11. The refrigeration cycle apparatus of claim 4, further comprising a liquid reservoir provided between the condenser and the expansion device.

12. The refrigeration cycle apparatus of claim 4, further comprising:

a bypass pipe that connects a location between the condenser and the expansion device and a location between the evaporator and the compressor; and a bypass valve provided at the bypass pipe.

* * * * *